US010242567B2

(12) United States Patent
Li et al.

(10) Patent No.: US 10,242,567 B2
(45) Date of Patent: Mar. 26, 2019

(54) TRAFFIC LIGHT AND TRAFFIC LIGHT COLOR IDENTIFICATION SYSTEM, AND METHODS THEREOF

(71) Applicant: BOE TECHNOLOGY GROUP CO., LTD., Beijing (CN)

(72) Inventors: Yingyi Li, Beijing (CN); Jian Gao, Beijing (CN); Kairan Liu, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 15/564,945

(22) PCT Filed: Apr. 21, 2017

(86) PCT No.: PCT/CN2017/081326
§ 371 (c)(1),
(2) Date: Oct. 6, 2017

(87) PCT Pub. No.: WO2018/014616
PCT Pub. Date: Jan. 25, 2018

(65) Prior Publication Data

US 2018/0308352 A1 Oct. 25, 2018

(30) Foreign Application Priority Data

Jul. 18, 2016 (CN) ..... 2016 1 0565934

(51) Int. Cl.

| | |
|---|---|
| ***G08G 1/07*** | (2006.01) |
| ***G08G 1/095*** | (2006.01) |
| ***G08G 1/04*** | (2006.01) |
| ***G08G 1/0967*** | (2006.01) |

(52) U.S. Cl.
CPC ..... *G08G 1/07* (2013.01); *G08G 1/04* (2013.01); *G08G 1/095* (2013.01); *G08G 1/096716* (2013.01); *G08G 1/096783* (2013.01)

(58) Field of Classification Search
CPC ..... G08G 1/00; G08G 1/07; G08G 1/091; G08G 1/092; G08G 1/095; G08G 1/096;
(Continued)

(56) References Cited

U.S. PATENT DOCUMENTS

RE21,818 E * 6/1941 Halstead ..... G08G 1/095 340/901
2003/0179106 A1 9/2003 Neff
(Continued)

FOREIGN PATENT DOCUMENTS

CN 1353404 A 6/2002
CN 2824178 Y 10/2006
(Continued)

OTHER PUBLICATIONS

First Office Action in the Chinese Patent Application No. 201610565934.9, dated Apr. 3, 2018; English translation attached.
(Continued)

*Primary Examiner* — Van T Trieu
(74) *Attorney, Agent, or Firm* — Westerman, Hattori, Daniels & Adrian, LLP

(57) ABSTRACT

Traffic light and traffic light color identification system, and methods thereof are provided. A traffic light includes a control unit, configured to generate a control command; a signal modulating unit, configured to modulate an electrical signal based on the control command and output a modulation signal having a modulation frequency corresponding to a color of a signal light of the traffic light; and a signal generating unit configured to control the signal light of the
(Continued)

traffic light and to transfer a signal to a vehicle, based on the modulation signal.

4 Claims, 7 Drawing Sheets

(58) Field of Classification Search
CPC .. G08G 1/161; G08G 1/166; G08G 1/096708; G08G 1/096733; G08G 1/09675; G08G 1/096766; G08G 1/096783; G08G 1/096791
See application file for complete search history.

(56) References Cited

U.S. PATENT DOCUMENTS

| | | | | |
|---|---|---|---|---|
| 2014/0191882 | A1 | 7/2014 | Varma | |
| 2015/0279215 | A1* | 10/2015 | Shibata | G08G 1/166 340/435 |
| 2016/0070965 | A1 | 3/2016 | Nelson | |

FOREIGN PATENT DOCUMENTS

| | | | |
|---|---|---|---|
| CN | 1990936 | A | 7/2007 |
| CN | 101593436 | A | 12/2009 |
| CN | 101783964 | A | 7/2010 |
| CN | 102610115 | A | 7/2012 |
| CN | 103886767 | A | 6/2014 |
| CN | 104363382 | A | 2/2015 |
| CN | 105469618 | A | 4/2016 |
| CN | 106205152 | A | 12/2016 |

OTHER PUBLICATIONS

Visible communication for advanced driver assistant systems, Navin Kumar et al., Conftele 2009-7th Conference on Telecommunications, Dec. 31, 2009.

International Search Report & Written Opinion dated Jun. 30, 2017, regarding PCT/CN2017/081326.

* cited by examiner

TRAFFIC LIGHT AND TRAFFIC LIGHT COLOR IDENTIFICATION SYSTEM, AND METHODS THEREOF

CROSS-REFERENCE TO RELATED APPLICATION

This application is a national stage application under 35 U.S.C. § 371 of International Application No. PCT/CN2017/081326, filed Apr. 21, 2017, which claims priority to Chinese Patent Application No. 201610565934.9, filed Jul. 18, 2016, the contents of which are incorporated by reference in the entirety.

TECHNICAL FIELD

The present disclosure generally relates to the optical communication technologies and, more particularly, to traffic light and traffic light color identification system, and their methods.

BACKGROUND

With the development of economy, traffic network expands in various directions. A large number of privately-owned vehicles are used in people's daily life. However, many people with color vision deficiency cannot obtain a driver's license because of the restrictions of traffic rules. Also, because of the color vision deficiency or color blindness, these people encounter a lot of inconvenience when walking on the streets.

In 2003, the Visible Light Communications Consortium (VLCC) was founded. The VLCC has been widely promoting the use of flashing light-emitting diode (LED) light sources for data transmission, to implement visible light communication.

Compared to technologies such as cable communication and radio frequency (RF) communication, visible light communication has at least the following advantages. First, visible light communication does not require application for a spectrum authentication. In the field of communication, the available radio frequencies are already quite limited. Visible light communication based on, e.g., LED, does not have the frequency allocation problems in the radio frequency communication, and is less susceptible to interferences. Further, the spectral band of the communication signals used in the visible light communication is often in the range of about 380 nm to about 780 nm, which is safe to humans. The visible light communication can thus be used in an environment such as hospitals, and other places having strict requirements on electromagnetic interferences. Further, visible light communication is often easy to debug and easy to implement. In addition, visible light communication is often less costly.

There are many types of color vision deficiencies, among which the most common type is the red-green color blindness. In general, people with color blindness are not able to accurately identify traffic lights and the information delivered by the traffic lights. Color blindness generally has two symptoms. One symptom is that the patients confuse two different colors A and B. The patients may think A and B are the same color. For example, a patient with red-color blindness is not able to distinguish between red and dark green. Another symptom is that, the patients are not able to sense colors but can only sense different tones, i.e., different levels of brightness and darkness.

Thus, a visible light communication means to provide a system for identifying colors of traffic lights for those people with color vision deficiencies is desired.

SUMMARY

One aspect of the present disclosure provides a traffic light. The traffic light includes: a control unit, configured to generate a control command; a signal modulating unit, configured to modulate an electrical signal based on the control command and output a modulation signal having a modulation frequency corresponding to a color of a signal light of the traffic light; and a signal generating unit configured to control the signal light of the traffic light and to transfer a signal to a vehicle, based on the modulation signal.

Optionally, the signal modulating unit is further configured to modulate a current intensity of the signal light such that a lowest current intensity is greater than 0.

Optionally, the signal modulating unit is further configured to modulate the current intensity of the signal light using an amplitude shift keying method.

Optionally, the lowest current intensity is about ⅓ to about ½ of a highest current intensity of the signal light.

Optionally, the signal light emits at a negative angle downwards to a ground and with respect to a horizontal direction.

Optionally, an absolute value of the negative angle is greater than or equal to about 5° and smaller than or equal to about 10°.

Optionally, the signal transferred to the vehicle is a light signal including a visible light signal.

Optionally, the signal is receivable by a signal demodulating unit on the vehicle.

Another aspect of the present disclosure provides a traffic light color identification system. The traffic light color identification system includes: a light-signal collecting unit, configured to collect a light signal and converting the light signal to an electrical signal; a signal demodulating unit, configured to obtain a modulation frequency of the electrical signal; and a playing unit, configured to inform a color of the light signal, after an identifying unit determines the color of the light signal based on the modulation frequency of the electrical signal.

Optionally, the playing unit includes a display unit configured to display at least one of text or a graphic based on the color determined by the identifying unit.

Optionally, the playing unit includes a voice unit configured to play back a voice based on the color determined by the identifying unit.

Optionally, the light-signal collecting unit is mounted over a headlight or a top of a vehicle.

Optionally, the light-signal collecting unit includes: a reflective panel configured to reflect the light signal and expanding a light region of the light signal, and an image collecting device configured to collect the light signal in the light region and converting the light signal to the electrical signal.

Optionally, the reflective panel includes a base panel and scattering particles coated over the base panel.

Optionally, the light signal is a visible light signal.

Another aspect of the present disclosure provides a method by generating a control command; modulating an electrical signal based on the control command to provide a modulation signal; outputting the modulation signal having a modulation frequency corresponding to a color of a signal light of the traffic light; and controlling the signal light to transfer a signal based on the modulation signal and receivable by a vehicle.

Optionally, the method further includes: modulating a current intensity of the signal light such that a lowest current intensity is greater than 0. The lowest current intensity is about ⅓ to about ½ of a highest current intensity of the signal light.

Optionally, the signal light emits at a negative angle downwards to a ground and with respect to a horizontal direction, and an absolute value of the negative angle is greater than or equal to about 5° and smaller than or equal to about 10°.

Optionally, the signal transferred to the vehicle is a light signal including a visible light signal.

Optionally, the method further includes: collecting the light signal; converting the light signal to the electrical signal; obtaining the modulation frequency of the electrical signal; and determining the color of the light signal based on the modulation frequency of the electrical signal.

BRIEF DESCRIPTION OF THE FIGURES

The following drawings are merely examples for illustrative purposes according to various disclosed embodiments and are not intended to limit the scope of the present disclosure.

DETAILED DESCRIPTION

Exemplary embodiments will now be described in detail with reference to the drawings. It is to be noted that the following descriptions of some embodiments are presented herein for purposes of illustration and description only. It is not intended to be exhaustive or to be limiting.

Figure 1:
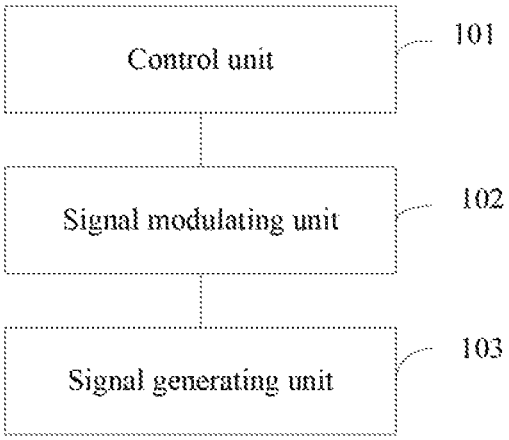
FIG. 1 illustrates exemplary traffic lights according to various disclosed embodiments of the present disclosure.

FIG. 1 illustrates the block diagram of an exemplary traffic light. As shown in FIG. 1, the disclosed traffic light includes a control unit 101, a signal modulating unit 102, and a signal generating signal 103. The traffic light may include signal lights emitting light of different colors, e.g., red, green, and yellow.

In various embodiments, a traffic information managing system may send a control signal to the control unit 101 through a communication network. The control unit 101 may generate a control command based on the control signal for adjusting electrical signals sent to the signal lights.

The signal modulating unit 102 may modulate frequencies of the electrical signals sent to the signal lights based on the control command, and output modulation signals of different frequencies. The modulation signals of different frequencies may correspond to signal lights of different colors.

The signal generating unit 103 may control signal lights of different colors to emit light based on the modulation signals.

The disclosed traffic lights may modulate the frequencies of the electrical signals sent to the signal lights such that the modulation signals of different modulation frequencies may correspond to signal lights of different colors. The present disclosure may provide a traffic light that can be identified or recognized by a color identification system, for people with color vision deficiencies. Driving may be safer for those people.

In various embodiments, the signal generating unit 103 may include LED lights with a high photoelectric conversion rate to generate a signal that can be received by a vehicle. Such signal may be a light signal, for example, including visible light signals of different colors. Often, the signal generating unit 103 may include a red LED signal light, a yellow LED signal light, and a green LED signal light. The signal modulating unit 102 may modulate the frequency of the electrical signal of a signal light, where the frequency of the electrical signal represents a number of times the traffic light flashes in 1 second. In various embodiments, modulation signals of different frequencies may be generated such that different modulation signals may correspond to signal lights of different colors.

In another embodiment, the signal modulating unit 102 may also be used to modulate the current intensities of the signal lights such that the lowest current intensity is greater than zero. In various embodiments, the modulating unit 102 may also use an amplitude shift keying (ASK) method to modulate the current intensities of the signal lights. Specifically, the ASK method may use data bits to control the current intensity of an LED light so as to control the brightness level of the LED light. When the data bit is 1, the current intensity may be the highest and the LED light may have a relatively high brightness level, i.e., appearing bright; and when the data bit is 0, the current intensity may be the lowest and the LED light may have a relatively low brightness level, i.e., appearing dark.

In the present disclosure, the ASK method is used to control the amplitudes, i.e., the brightness levels of the LED lights, of the light signals through modulating signals and controlling current intensities. In various embodiments, a current intensity range may correspond to a signal light having a certain color. For example, the current intensity of the red LED signal light may be the highest, the current intensity of the yellow LED signal light may be moderate, and the current intensity of the green LED signal light may be the lowest. In some embodiments, the lowest current intensity may be about a third or about a half of the highest current intensity.

Figure 2A:
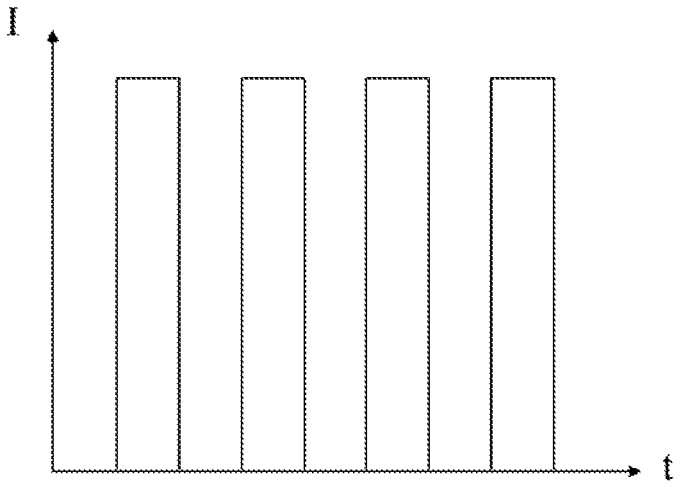
FIGS. 2A-2C each illustrates current intensity in an exemplary traffic light according to various disclosed embodiments of the present disclosure.
Figure 2B:
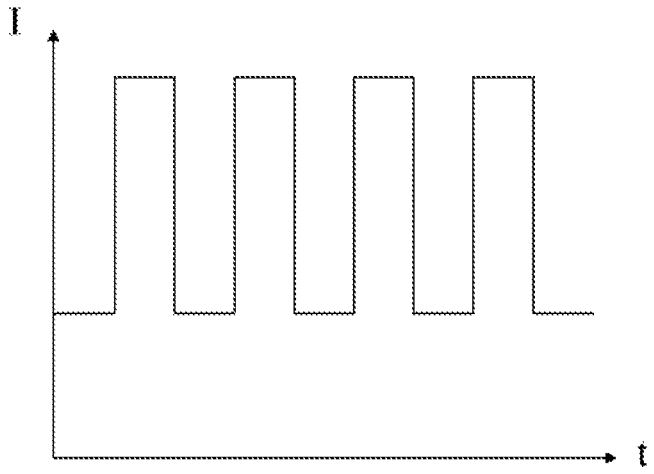
Figure 2C:
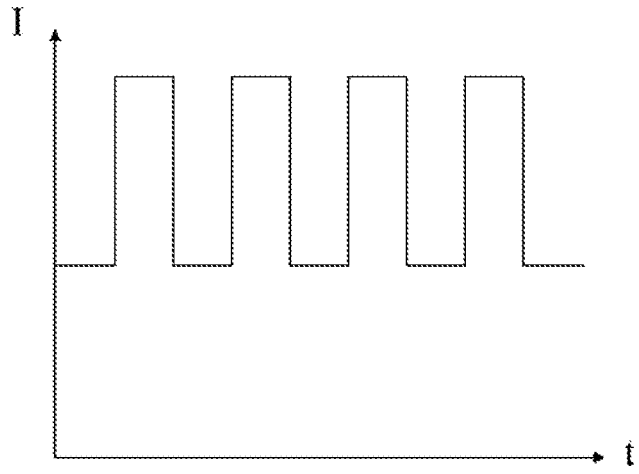

FIGS. 2A, 2B, and 2C each illustrates the current intensity of a signal light according to an exemplary embodiment. In FIGS. 2A, 2B, and 2C, I represents the current intensity of an LED signal light, and t represents time.

The brightness level of an LED signal light may be dependent on the current intensity of the LED signal light. A higher current intensity in an LED signal light may correspond to a higher brightness level of the LED signal light. The brightness level of an LED signal light may be an average brightness level during a unit of time. For example, assume a duty cycle of the signal modulation is about 50%. If the lowest current intensity of the signal light is 0, as shown in FIG. 2A, the brightness level or average brightness level of the LED signal light is about half of the maximum brightness level at the highest current intensity. If the lowest current intensity of the signal light is about one third of the highest current intensity, as shown in FIG. 2B, the average brightness level of the LED signal light may be about two third of the maximum brightness level at the highest current intensity, which is about 33% higher than the average brightness level in the zero lowest current intensity situation illustrated in FIG. 2A. Further, if the lowest current intensity of the signal light is about one half of the highest current intensity, as shown in FIG. 2C, the average brightness level of the LED traffic light can be about 50%, higher than the average brightness level in the zero lowest current intensity situation illustrated in FIG. 2A.

In some embodiments, the lowest current intensity, after modulation, may be higher than zero. Thus, when the brightness level of the surroundings is high, the LED signal lights may still have sufficient brightness levels such that a high contrast, between the brightness levels of the LED signal lights and the brightness level of the light source in the surroundings, may be obtained. The intensities of the light signals emitted by the signal lights may be improved, making it easier for a receiving terminal, such as a vehicle or a device configured with the vehicle, to collect the light signals.

Figure 3:
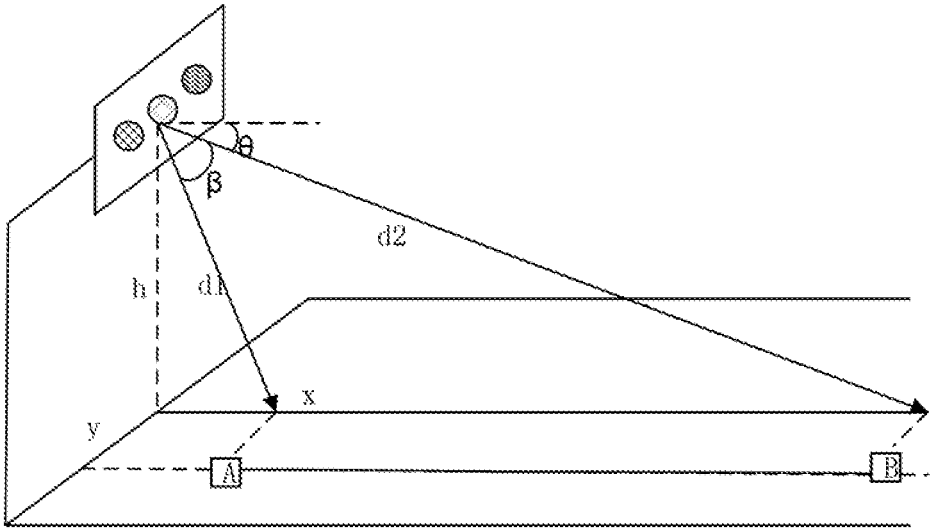
FIG. 3 illustrates the light-emitting direction of an exemplary traffic light according to various disclosed embodiments of the present disclosure.

FIG. 3 illustrates the light-emitting direction by a signal light of the traffic light in one embodiment. As shown in FIG. 3, the signal light has a height h above the ground, a lateral distance between the receiving terminal and the signal light is x, and a longitudinal distance between the receiving terminal and the signal light is y. The distance d between the receiving terminal and the traffic terminal may be calculated using equation:

$$d=\sqrt{x^2+y^2+h^2}.$$

A greater distance d between the receiving terminal and the traffic light may result in a greater difficulty to collect signals. When a vehicle having the receiving terminal moves to location A shown in FIG. 3, the distance d1 between the receiving terminal and the signal light may be smaller than the distance d2 between the receiving terminal and the traffic light when the vehicle is at location B. The receiving terminal may receive or collect signals when moving between location A and location B. The signal light may emit light along the direction shown in FIG. 3, the light-emission angle of the traffic light may be β. When the distance between the receiving terminal and the traffic light is smaller than d1, no or little light may be incident on the receiving terminal, and the receiving terminal may not be able to collect any signals.

Thus, to better collect light signals when the distance between the receiving terminal and the traffic light is small, the light-emitting direction of the disclosed traffic light may have a preset negative angle θ in a direction downwards to the ground and with respect to the horizontal direction. An absolute value of the preset negative angle θ may be greater than or equal to about 5° and smaller than or equal to about 10°. In various embodiments, the negative angle θ between the light-emitting direction and the horizontal direction should not be too large or too small. If the absolute value of the negative angle θ is too large, the receiving terminal may not be able to receive signals when the receiving terminal is far away from the signal light. If the absolute value of the negative angle θ is too small, the receiving terminal may not be able to receive signals when the receiving terminal is too close to the signal light.

Figure 4:
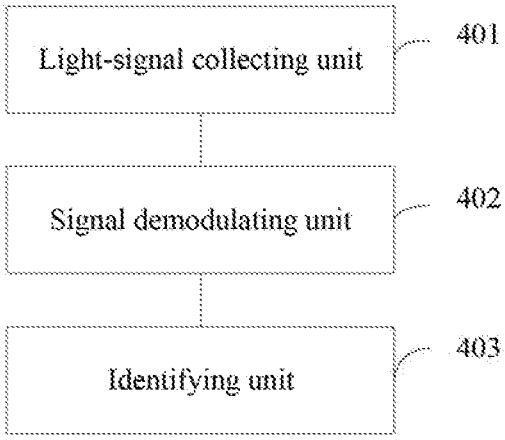
FIG. 4 illustrates an exemplary system for identifying colors of traffic lights according to various disclosed embodiments of the present disclosure.

FIG. 4 illustrates the block diagram of an exemplary traffic light color identification system according to some embodiments of the present disclosure. As shown in FIG. 4, the disclosed traffic light color identification system includes a light-signal collecting unit 401, a signal demodulating unit 402, and an identifying unit 403. The disclosed system or specifically, the light-signal collecting unit 401 may be a receiving terminal.

The light-signal collecting unit 401 may collect a visible light signal emitted by a signal light of a traffic light, such as one of the exemplary traffic lights described above, and convert the visible light signal to a corresponding electrical signal.

The light-signal collecting unit 401 may include a photoelectric sensor. The light-signal collecting unit 401 may collect the modulated visible light signal and covert the modulated visible light signal to the corresponding electrical signal using the photoelectric sensor.

The signal demodulating unit 402 may obtain the frequency of the electrical signal corresponding to the visible light signal.

The identifying unit 403 may determine the color of the signal light based on the frequency of the electrical signal corresponding to the visible light signal.

Visible light signals of different colors, after modulation, may correspond to electrical signals of different frequencies. Based on the frequency of the electrical signal corresponding to a visible light signal, obtained by the signal demodulating unit 402, the identifying unit 403 may determine the color of the signal light emitting the visible light signal.

The disclosed traffic light color identification system may collect the visible light signal and demodulate the collected visible light signal to the electrical signal corresponding to the visible light signal. The disclosed system may determine the color of a signal light based on the frequency of the electrical signal corresponding to a light signal emitted by the signal light. The disclosed system may thus identify the colors of the traffic light, providing a means to accurately identify the colors of the traffic light for those having color vision deficiencies.

In various embodiments, the traffic light color identification system may include a playing unit configured to provide information including a color of the light signal. For example, the playing unit may include a display unit and/or a voice unit for informing the color of the light signal.

Figure 6:
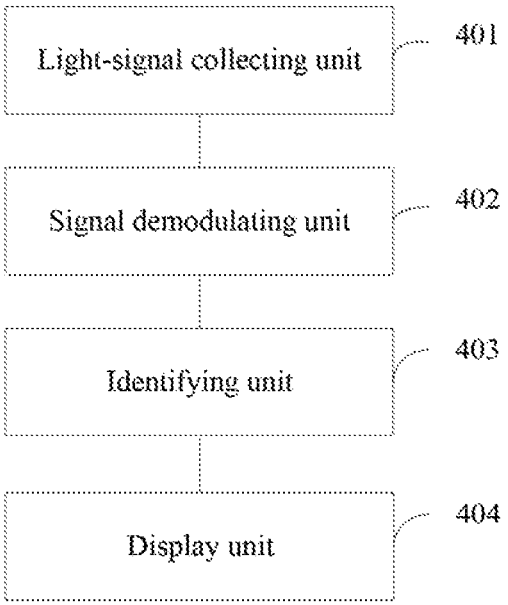
FIG. 6 illustrates another exemplary system for identifying colors of traffic lights according to various disclosed embodiments of the present disclosure.

FIG. 6 illustrates anther exemplary traffic light color identification system according to the present disclosure. The traffic light color identification system shown in FIG. 6 is similar to the system shown in FIG. 4, except that the system shown in FIG. 6 further includes a display unit 404.

The display unit 404 may display text or graphic corresponding to the color of the signal light, based on the identification result by the identifying unit 403. The disclosed traffic light color identification system may display different kinds of text and graphics for signal lights of different colors. For example, when the identification result is the red LED signal light, the corresponding text may be "red" and the corresponding graphic may be "!". When the identification result is the yellow LED signal light, the corresponding text may be "yellow" and the corresponding graphic may be "◎". When the identification result is the green LED signal light, the corresponding text may be "green" and the corresponding graphic may be "◎". In various embodiments, the display unit 404 may be arranged on a rearview mirror of a vehicle such that a driver may learn about the color of the signal light through the text or graphic shown by the display unit 404.

The disclosed traffic light color identification system may collect the visible light signal and demodulate the collected visible light signal to the electrical signal corresponding to the visible light signal. The disclosed system may determine the color of the signal light based on the frequency of the electrical signal corresponding to the visible light signal emitted by the signal light. The disclosed system may display the text or graphic corresponding to the color of the signal light such that people having color blindness may be able to determine the color of the signal light.

Figure 7:
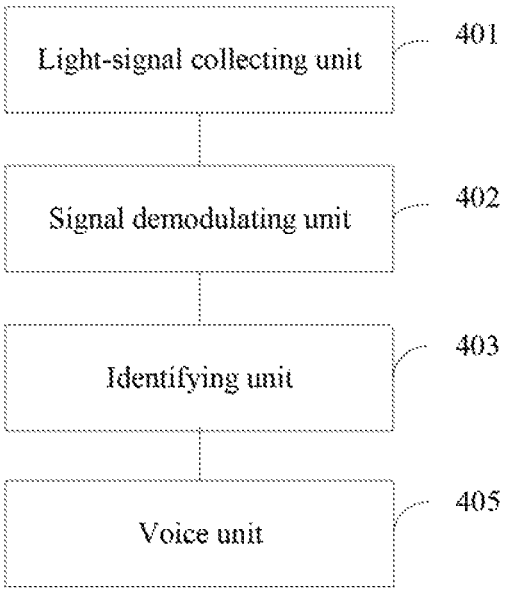
FIG. 7 illustrates another exemplary system for identifying colors of traffic lights according to various disclosed embodiments of the present disclosure.

FIG. 7 illustrates another exemplary traffic light color identification system according to the present disclosure. The traffic light color identification system shown in FIG. 7 is similar to the system shown in FIG. 4, except that the system shown in FIG. 7 further includes a voice unit 405.

The voice unit 405 may play back a voice message corresponding to the color of the signal light based on the identification result by the identifying unit 403.

The disclosed traffic light color identification system may collect the visible light signal and demodulate the collected visible light signal to the electrical signal corresponding to the visible light signal. The disclosed system may determine the color of the signal light based on the frequency of the electrical signal corresponding to the visible light signal emitted by the signal light. The disclosed system may play the voice message corresponding to the identified color of the signal light such that people with color blindness may determine the color of the signal light.

In an embodiment, the light-signal collecting unit 401 may collect the visible light signal emitted by the traffic light and convert the collected visible light signal to the corresponding electrical signal. In various embodiments, the light-signal collecting unit 401 may be a camera with a rolling shutter, which can progressively and sequentially expose the collected visible light signal. The LED light emitting the visible light signal may flash constantly. An imaging unit in the camera may convert the collected visible light signal to a digitized electrical signal, and an image processing unit in the camera may amplify and decode the electrical signal to form an image.

Figure 5:
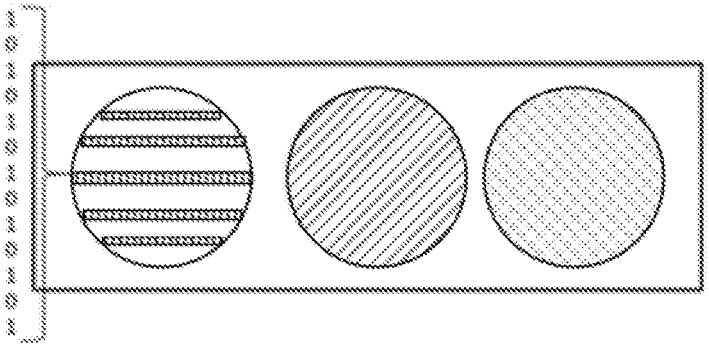
FIG. 5 illustrates exemplary modulation information by an exemplary signal demodulating unit according to various disclosed embodiments of the present disclosure.

An exemplary image taken by the camera is shown in FIG. 5. The image includes the images of the three signal lights, i.e., the red, green, and yellow signal lights. The image of one signal light may include alternately-arranged bright strips and dark strips, i.e., one bright strip being sandwiched by two dark strips and vice versa. A bright strip indicates the LED light turns bright and a dark strip indicates the LED light turns dark. The signal demodulating unit 402 may demodulate the electrical signal corresponding to the visible light signal collected by the light-signal collecting unit 401. Exemplary demodulation information is shown in FIG. 5, which includes a "1010 . . . 1" string. The binary 1 indicates the LED appears bright and the binary 0 indicates the LED appears dark. The signal demodulating unit 402 may demodulate the visible light signal into a binary code. Because signal lights of different colors may flash at different frequencies, the signal demodulating unit 402 may obtain the color of the signal light based on the binary code demodulated from the electrical signal corresponding to the visible light signal.

The demodulation of the electrical signal may correspond to the embodiment described above in connection with FIGS. 2A-2C, in which the ASK method is used to modulate the current intensities of the signal lights. The signal demodulating unit 402 may demodulate the electrical signal corresponding to the visible light signal modulated using the ASK method and collected by the light-signal collecting unit 401, to obtain the intensity of the electrical signal. The identifying unit 403 may determine the color of the signal light based on the intensity of the electrical signal. Specifically, the color of a signal light may be determined based on a correspondence relationship between current intensity ranges and colors, where the correspondence relationship may be predetermined. For example, when the current intensity is relatively high, the identifying unit 403 may determine that the red LED light is on. When the current intensity is medium, the identifying unit 403 may determine that the yellow LED light is on. When the current intensity is relatively low, the identifying unit 403 may determine that the green LED light is on.

Figure 8A:
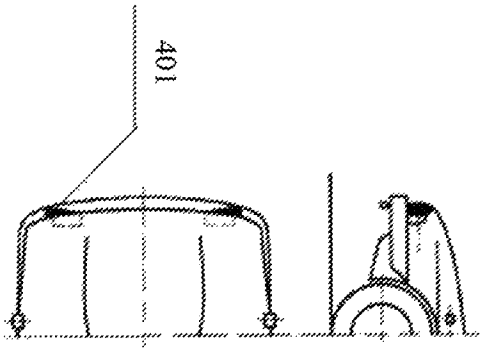
FIGS. 8A and 8B each illustrates an exemplary position of a light-signal collecting unit in an exemplary system for identifying colors of traffic lights according to various disclosed embodiments of the present disclosure.
Figure 8B:
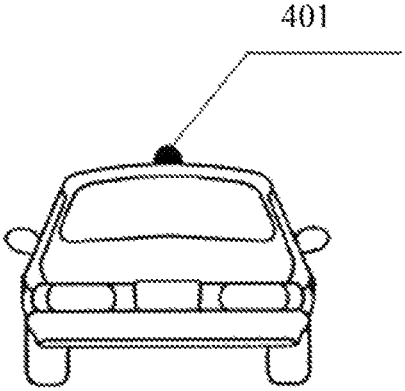

In various embodiments, the light-signal collecting unit 401 may also be mounted over a headlight of the vehicle, as shown in FIG. 8A, or over the top of the vehicle, as shown in FIG. 8B. The specific location of the light-signal collecting unit 401 should not be limited by the embodiments of the present disclosure.

Figure 9:
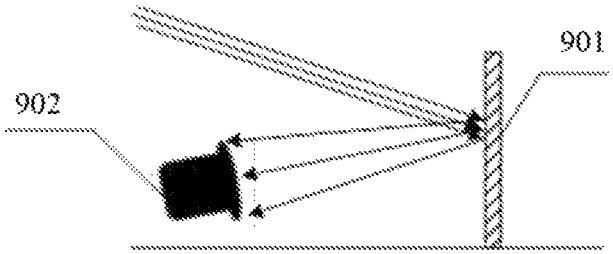
FIG. 9 illustrates an exemplary light-signal collecting unit in an exemplary system for identifying colors of traffic lights according to various disclosed embodiments of the present disclosure.

In another embodiment of the present disclosure, as shown in FIG. 9, the light-signal collecting unit 401 includes a reflective panel 901 and an image collecting device 902.

The reflective panel 901 may reflect and expand a visible light region of the signal light, and project the visible light region to the image collecting device 902. The visible light region of the signal light refers to the region the visible light signal emitted by the signal light is incident on. In various embodiments, the reflective panel 901 may be arranged in any suitable position. For example, the reflective panel 901 may be mounted on a front windshield of the vehicle.

The image collecting device 902 may collect the light or visible light signal reflected by the light-reflecting region of the reflective panel 901, and convert the collected visible light signal to the electrical signal. In various embodiments, the image collecting device 902 may be a camera with a rolling shutter. The camera may progressively and sequentially expose the collected visible light signal reflected by the reflective panel 901. An imaging unit in the camera may convert the collected visible light signal to a digitized electrical signal, amplify and decode the electrical signal through an image processing unit to form an image. Because the LED light emitting the visible light signal flash constantly, the image obtained by the camera may have alternately-arranged bright strips and dark strips. Bright strips may indicate that the LED light appears bright, and dark strips may indicate that the LED light appears dark.

The reflective panel arranged in the disclosed traffic light color identification system may reflect the visible light signal emitted by the traffic light and expand the visible light region to the image collecting device such that the image collecting device does not need to adjust the filming angle to capture the visible light signals. Thus, the image collecting device may be fixed on the vehicle.

Figure 10:
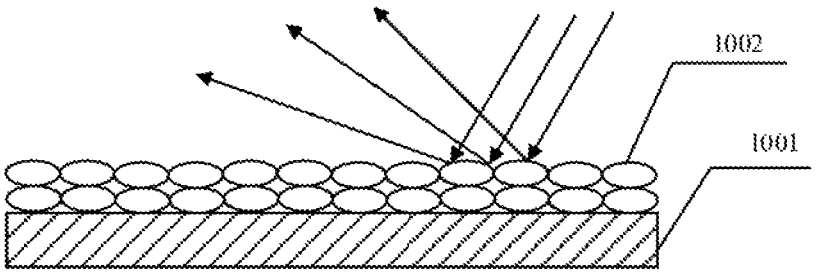
FIG. 10 illustrates an exemplary reflective panel in a light-signal collecting unit according to various disclosed embodiments of the present disclosure.

Further, as shown in FIG. 10, the reflective panel 901 includes a base panel 1001 and scattering particles 1002 coated over the base panel 1001 for reflecting the visible light signals to the image collecting device 902 by diffuse reflection. The scattering particles 1002 over the base panel 1001 may reduce the mirror reflection of the visible light signals emitted by the LED lights and increase the visible light region of the traffic light. The visible light signals may be reflected to the image collecting device 902 for the image collecting device 902 to collect.

Figure 11:
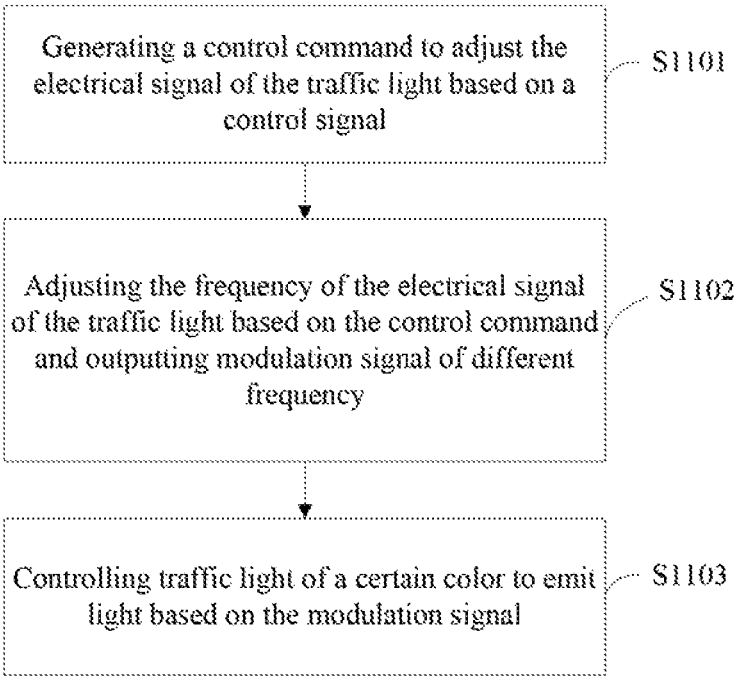
FIG. 11 illustrates an exemplary process to control traffic lights according to various disclosed embodiments of the present disclosure.

FIG. 11 illustrates an exemplary process for controlling the traffic light. As shown in FIG. 11, at S101, a control command for adjusting an electrical signal of the traffic light is generated based on a control signal.

In various embodiments, a traffic information managing system may send the control signal to the traffic light through a communication network. The traffic light may generate the control command based on the control signal, to control the signal light of a corresponding color, e.g., red, to emit light. In the meantime, the control command may also turn off the signal lights of other colors, e.g., green and yellow.

At S1102, a frequency of the electrical signal of the traffic light is adjusted based on the control command and a modulation signal of a modulation frequency is outputted. Modulation signals of different modulation frequencies may correspond to signal lights of different colors.

In various embodiments, the modulation signals of different modulation frequencies may be set such that the modulation signals of different frequencies may correspond to signal lights of different colors. For example, when the control command is configured to control the red LED light to emit light, the frequency of the electrical signal corresponding to the red LED light may be modulated based on the control command, to output the modulation signal corresponding to the red LED light.

At S1103, a signal light of a certain color is controlled to emit light based on the modulation signal.

For example, when the modulation signal corresponding to the red LED light is generated, the modulation signal may be used to control the red LED light to emit light.

In some embodiments, the method for controlling the traffic light may include modulating a current intensity of the signal light using the ASK method. A correspondence relationship between current intensity ranges and colors of the signal lights can be preset. Specifically, the ASK method may use data bits to control the current intensity of an LED light, so as to control the brightness level of the LED light. In the present disclosure, the ASK method may be used to control current intensities through modulation signals, and amplitudes of visible light signals, i.e., brightness levels of the LED lights, may thus be controlled. In various embodiments, different current intensity ranges may correspond to signal lights of different colors. For example, the current intensity of the red LED signal light may be set to a relatively high value, the current intensity of the yellow LED signal light may be set to a moderate value, and the current intensity of the green LED signal light may be set to a relatively low value.

Figure 12:
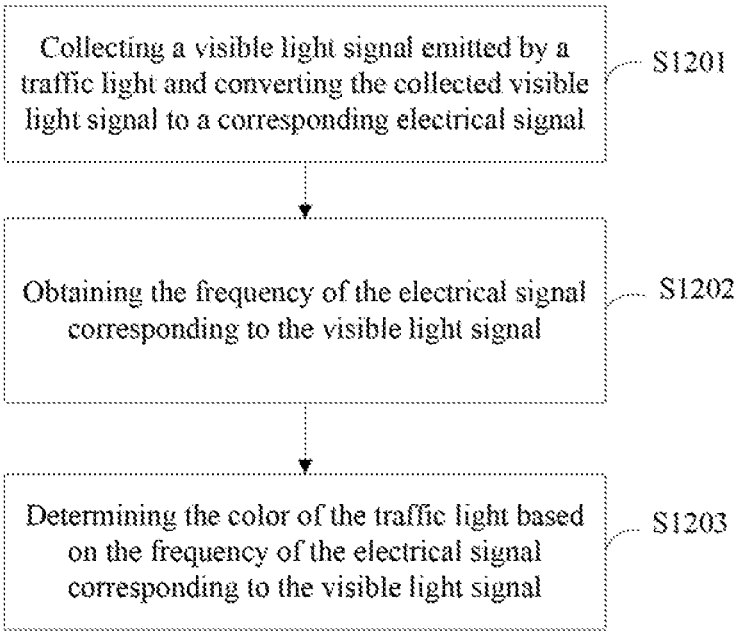
FIG. 12 illustrates an exemplary process to identify colors of traffic lights according to various disclosed embodiments of the present disclosure.

FIG. 12 illustrates an exemplary process for identifying a color of a traffic light. As shown in FIG. 12, at S1201, a visible light signal emitted by a signal light of the traffic light is collected and converted to a corresponding electrical signal.

In various embodiments, a camera with a rolling shutter may be used to collect the visible light signal, and an imaging unit of the camera may convert the visible light signal to the corresponding electrical signal.

At S1202, a frequency of the electrical signal corresponding to the visible light signal is obtained.

In various embodiments, because the signal light, which is an LED light emitting the visible light signal, may flash constantly, the image of the signal light obtained by the camera may include alternately-arranged bright strips and dark strips. A bright strip indicates that the LED light appears bright, and a dark strip indicates that the LED light appears dark. Binary code may be used to represent the status of the LED light. In one embodiment, binary 1 may represent that the LED turns bright, and the binary 0 may represent that the LED turns dark. Thus, the binary code of the visible light signal may be obtained. The frequency of the electrical signal corresponding to the visible light signal may be determined.

At S1203, a color of the signal light is determined based on the frequency of the electrical signal corresponding to the visible light signal.

In various embodiments, visible light signals of different colors, after modulation, may correspond to electrical signals of different frequencies. By obtaining the frequency of the electrical signal corresponding to the visible light signal, the color of the signal light emitting the visible light signal may be obtained.

In some embodiments, the method for identifying the color of traffic light may include obtaining the intensity of the electrical signal corresponding to the visible light signal, and determining the color of the visible light signal based on the intensity of the electrical signal. Specifically, corresponding to the ASK method described in the process for controlling the traffic light, the correspondence relationship between the current intensity ranges and the signal lights of different colors may be determined in advance. The color of the signal light may thus be determined according to the correspondence relationship. For example, when the current intensity is relatively high, it may be determined that the red LED signal light is on. When the current intensity is moderate, it may be determined that the yellow LED signal light is on. When the current intensity is relatively low, it may be determined that the green LED signal light is on.

The present disclosure provides a traffic light, a method for controlling the traffic light, and a system and a method for identifying a color of the traffic light. A collected visible light signal may be modulated to form an electrical signal corresponding to the visible light signal. The color of the traffic light may be determined based on the frequency of the electrical signal corresponding to the visible light. That is, the color of the traffic light may be identified. The present disclosure may thus provide a means to accurately identify the color of the traffic light for the people having color vision deficiency.

For illustrative purposes, the signal lights of the traffic light described in the present disclosure include LED lights. In various other embodiments, the signal lights may also include other suitable light sources capable of emitting visible light signals having modulated frequencies. The specific type of light source used in the traffic light should not be limited by the embodiments of the present disclosure.

In certain embodiments, a traffic light may also emit a light signal with a wavelength not in the visible range. The light signal may be modulated and demodulated by the disclosed traffic light color identification system such that the frequency of the light signal can be obtained for identifying the color of the traffic light.

In certain other embodiments, a traffic light may emit both a visible light signal and a light signal having a wavelength different from the visible light signal and is invisible to human eyes. The disclosed traffic light color identification system may also be able to obtain the frequency of the light signal. In this case, the traffic light may only need to modulate the frequency of the invisible light signal such that the brightness level of the traffic light can remain unaffected.

Figure 13:
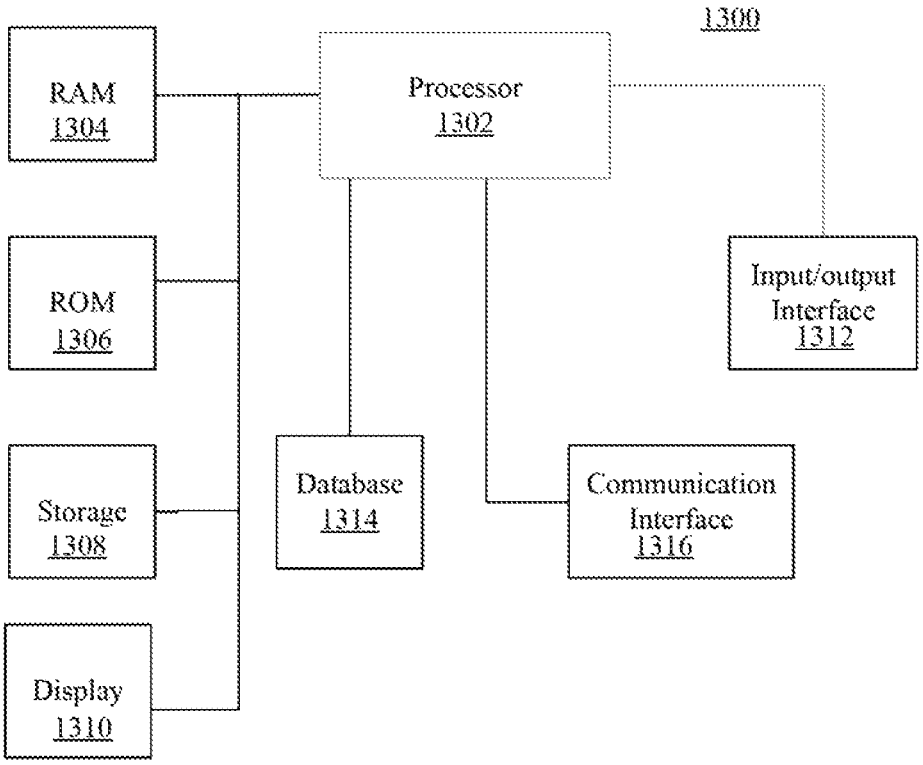
FIG. 13 illustrates an exemplary block diagram of a control unit in a system for identifying colors of traffic lights according to various disclosed embodiments of the present disclosure.

FIG. 13 illustrates a block diagram of a control circuit 1300 corresponding to the control 101 in FIG. 1. The control circuit 1300 may be integrated in a traffic light or may be a separate device. The control circuit 1300 may control various operations of the traffic light and may implement the functions of at least one of the control unit 101, the signal modulating unit 102, or the signal generating unit 103.

The control circuit 1300 may receive, process, and execute commands from a traffic information managing system. The control circuit 1300 may include any appropriately configured computer system. As shown in FIG. 13, the control circuit 1300 includes a processor 1302, a random access memory (RAM) 1304, a read-only memory (ROM) 1306, a storage 1308, a display 1310, an input/output interface 1312, a database 1314, and a communication interface 1316. Other components may be added to and certain components may be removed from the control circuit 1300 without departing from the principles of the disclosed embodiments.

The processor 1302 may include any appropriate type of general purpose microprocessor, digital signal processor or microcontroller, or application specific integrated circuit (ASIC). The processor 1302 may execute sequences of computer program instructions to perform various processes associated with the control circuit 1300. Computer program instructions may be loaded into the RAM 1304 for execution by the processor 1302 from the read-only memory 1306, or from the storage 1308. The storage 1308 may include any appropriate type of mass storage provided to store any type of information that the processor 1302 may need to perform the processes. For example, the storage 1308 may include one or more hard disk devices, optical disk devices, flash disks, or other storage devices to provide storage space.

The display 1310 may provide information to a user or users of the control circuit 1300, such as a maintenance technician of the traffic light. The display 1310 may include any appropriate type of computer display device or electronic device display (e.g., CRT or LCD based devices). The input/output interface 1312 may be provided for the user to input information into the control circuit 1300 or for the user to receive information from the control circuit 1300. For example, the input/output interface 1312 may include any appropriate input device, such as a keyboard, a mouse, an electronic tablet, voice communication devices, touch screens, or any other optical or wireless input devices. Further, the input/output interface 1312 may receive data from and/or send data to other external devices.

Further, the database 1314 may include any type of commercial or customized database, and may also include analysis tools for analyzing the information in the databases. The communication interface 1316 may provide communication connections such that the control circuit 1300 may be accessed remotely and/or communicate with other systems through computer networks or other communication networks via various communication protocols, such as transmission control protocol/internet protocol (TCP/IP), hypertext transfer protocol (HTTP), etc.

In one embodiment, the control circuit 1300 may receive a control signal from the traffic information managing system through the communication interface 1316. The processor 1302 may generate a control command for adjusting electrical signals of signal lights of the traffic light. The processor 1302 may modulate the frequencies of the electrical signals sent to the signal lights, and may output modulation signals of different frequencies. Modulation signals having different frequencies may correspond to signal lights of different colors. The processor 1302 may output the modulation signals to the signal lights through the input/output interface 1312.

The control circuit 1300 may also be used in the disclosed traffic light color identification system to control various operations of the system. The control circuit 1300 may implement the functions of at least one of the light-signal collecting unit 401, the signal modulating unit 402, the identifying unit 403, the display unit 404, or the voice unit 405.

In one embodiment, the disclosed system may receive the visible light signal emitted by a signal light through the input/output 1312, and the processor 1302 may convert the collected visible light signal to a corresponding electrical signal. The processor 1302 may obtain the frequency of the electrical signal that corresponds to the visible light signal, and determine the color of the signal light based on the frequency of the electrical signal. In some embodiments, the display 1310 may implement the functions of the display unit 404, which displays the color of the signal light. In some embodiments, the input/output interface 1312 may implement the functions of the voice unit 405 to play back a voice message corresponding to the color of the signal light so as to inform the user of the color of the signal light.

In the present disclosure, the terms "comprise", "include", or any other variant thereof are intended to encompass a non-exclusive inclusion such that the process, method, article or device comprising a series of elements includes not only those elements but also other elements that are not explicitly listed, or those that are inherent to such process, method, article, or device. In the absence of more restrictions, the elements defined by the statement "including a . . . " do not exclude the presence of additional elements in the process, method, article, or device that includes the elements. The orientation or positional relationship indicated by the terms "up", "down", etc. is based on the azimuth or positional relationship shown in the drawings and is only for the purpose of describing the embodiments and simplifying the description, rather than indicating or implying that the means or elements have a specific orientation, or are constructed and operated in a particular orientation. Thus, these terms are not construed as limiting the disclosure. The terms "mount", "connect", "link", and the like should be broadly understood. For example, these terms may indicate a fixed connection, a detachable connection, a one-piece connection, a mechanical connection, or an electrical connection. These terms may also indicate direct connection, indirect connection through intermediary, of internal connection between two components. The specific meaning of the above-mentioned terms in the present disclosure may be understood by those skilled in the art in light of specific circumstances.

A number of specific details are set forth in the specification of the present disclosure. It is to be understood, however, that embodiments of the disclosure may be practiced without these specific details. In some embodiments, well-known methods, structures, and techniques have not been shown in detail so as not to obscure the understanding of this specification. Similarly, it should be understood that in order to simplify the present disclosure and to assist in understanding one or more of the various inventive aspects, features of the present disclosure are sometimes grouped together into a single embodiment in the above description of exemplary embodiments of the present disclosure, or in the description of it. However, the disclosed method or device should not be construed as reflecting the intent that the claimed disclosure is more characteristic than the features clearly set forth in each claim. More specifically, as reflected in the claims, the inventive aspect can be less than all of the features of the previously disclosed single embodiment. Accordingly, the claims that follow the specific embodiments are expressly incorporated into this particular embodiment, each of which is a separate embodiment of the disclosure.

The foregoing description of the embodiments of the disclosure has been presented for purposes of illustration and description. It is not intended to be exhaustive or to limit the disclosure to the precise form or to exemplary embodiments disclosed. Accordingly, the foregoing description should be regarded as illustrative rather than restrictive. Obviously, many modifications and variations will be apparent to practitioners skilled in this art. The embodiments are chosen and described in order to explain the principles of the technology, with various modifications suitable to the particular use or implementation contemplated. It is intended that the scope of the disclosure be defined by the claims appended hereto and their equivalents in which all terms are meant in their broadest reasonable sense unless otherwise indicated. Therefore, the term "the disclosure", "the present disclosure" or the like does not necessarily limit the claim scope to a specific embodiment, and the reference to exemplary embodiments of the disclosure does not imply a limitation on the disclosure, and no such limitation is to be inferred. Moreover, the claims may refer to "first", "second", etc., followed by noun or element. Such terms should be understood as a nomenclature and should not be construed as giving the limitation on the number of the elements modified by such nomenclature unless specific number has been given. Any advantages and benefits described may not apply to all embodiments of the disclosure. It should be appreciated that variations may be made to the embodiments described by persons skilled in the art without departing from the scope of the present disclosure as defined by the following claims. Moreover, no element or component in the present disclosure is intended to be dedicated to the public regardless of whether the element or component is explicitly recited in the following claims.

What is claimed is:

1. A method, comprising:

generating a control command;

modulating an electrical signal based on the control command to provide a modulation signal;

outputting the modulation signal having a modulation frequency corresponding to a color of a signal light of the traffic light;

modulating a current intensity of the signal light such that a lowest current intensity is greater than 0, wherein the lowest current intensity is about ⅓ to about ½ of a highest current intensity of the signal light; and controlling the signal light to transfer a signal based on the modulation signal and receivable by a vehicle.

2. The method according to claim 1, wherein the signal transferred to the vehicle is a light signal including a visible light signal.

3. A method, comprising:

generating a control command;

modulating an electrical signal based on the control command to provide a modulation signal;

outputting the modulation signal having a modulation frequency corresponding to a color of a signal light of the traffic light; and controlling the signal light to transfer a signal based on the modulation signal and receivable by a vehicle, wherein the signal light emits at a negative angle downwards to a ground and with respect to a horizontal direction, and an absolute value of the negative angle is greater than or equal to about 5° and smaller than or equal to about 10°.

4. A method, comprising:

generating a control command;

modulating an electrical signal based on the control command to provide a modulation signal;

outputting the modulation signal having a modulation frequency corresponding to a color of a signal light of the traffic light;

controlling the signal light to transfer a signal based on the modulation signal and receivable by a vehicle, collecting the signal light;

converting the signal light to the electrical signal;

obtaining the modulation frequency of the electrical signal; and determining the color of the signal light based on the modulation frequency of the electrical signal.

* * * * *